US010732531B2

(12) United States Patent
Kikawa et al.

(10) Patent No.: US 10,732,531 B2
(45) Date of Patent: Aug. 4, 2020

(54) TONER, TWO-COMPONENT DEVELOPER, AND METHOD FOR PRODUCING TONER

(71) Applicant: SHARP KABUSHIKI KAISHA, Sakai, Osaka (JP)

(72) Inventors: Keiichi Kikawa, Sakai (JP); Yoritaka Tsubaki, Sakai (JP); Takeshi Katoh, Sakai (JP); Osamu Wada, Sakai (JP); Tadanori Kano, Sakai (JP); Yuya Kondo, Sakai (JP); Shoji Nakai, Sakai (JP); Hiroki Maeda, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/368,303

(22) Filed: Mar. 28, 2019

(65) Prior Publication Data

US 2019/0317418 A1 Oct. 17, 2019

(30) Foreign Application Priority Data

Apr. 12, 2018 (JP) ..... 2018-076583

(51) Int. Cl.
*G03G 9/087* (2006.01)
*G03G 9/097* (2006.01)
*G03G 9/08* (2006.01)

(52) U.S. Cl.
CPC ..... *G03G 9/08755* (2013.01); *G03G 9/081* (2013.01); *G03G 9/08782* (2013.01); *G03G 9/09733* (2013.01)

(58) Field of Classification Search
CPC ..... G03G 9/08755; G03G 9/09733; G03G 9/08782
See application file for complete search history.

(56) References Cited

U.S. PATENT DOCUMENTS 6,579,653 B1 * 6/2003 Yuasa ..... G03G 9/081 430/108.2
2010/0129751 A1 * 5/2010 Morris ..... G03G 9/0804 430/110.1
2010/0330486 A1 * 12/2010 Zhou ..... G03G 9/0802 430/108.4

(Continued)

FOREIGN PATENT DOCUMENTS

CN 107312297 A * 11/2017
JP 2002072557 A * 3/2002

(Continued)

OTHER PUBLICATIONS

English langauge machine translation of JP 2002-072557 (Year: 2002).*

(Continued)

*Primary Examiner* — Christopher D Rodee
(74) *Attorney, Agent, or Firm* — ScienBiziP, P.C.

(57) ABSTRACT

A toner contains at least a crystalline polyester resin and an amorphous linear polyester resin that uses diethylene glycol as an alcohol component, and a monoester wax and a montan ester wax as release agent components, wherein $6 \leq \alpha \leq 8$ and $14 \leq mw/\alpha < 30$ are satisfied, where $\alpha$ represents an amount of the crystalline polyester resin added relative to 100 parts by weight of the amorphous linear polyester resin and mw represents an amount of the montan ester wax added.

2 Claims, 1 Drawing Sheet

(56) References Cited

U.S. PATENT DOCUMENTS

| | | | | |
|---|---|---|---|---|
| 2015/0227073 | A1* | 8/2015 | Imamoto ..... | G03G 9/08755<br>430/105 |
| 2017/0115589 | A1 | 4/2017 | Nakai et al. | |
| 2018/0173127 | A1* | 6/2018 | Moffat ..... | G03G 15/6585 |

FOREIGN PATENT DOCUMENTS

| | | | | |
|---|---|---|---|---|
| JP | 2004226847 | A | * | 8/2004 |
| JP | 2007071993 | A | * | 3/2007 |
| JP | 2017-083525 | A | | 5/2017 |

OTHER PUBLICATIONS

English langauge machine translation of JP 2004-226847 (Year: 2004).*
English langauge machine translation of JP 2007-071993 (Year: 2007).*
English langauge machine translation of CN 107312297 (Year: 2017).*

* cited by examiner

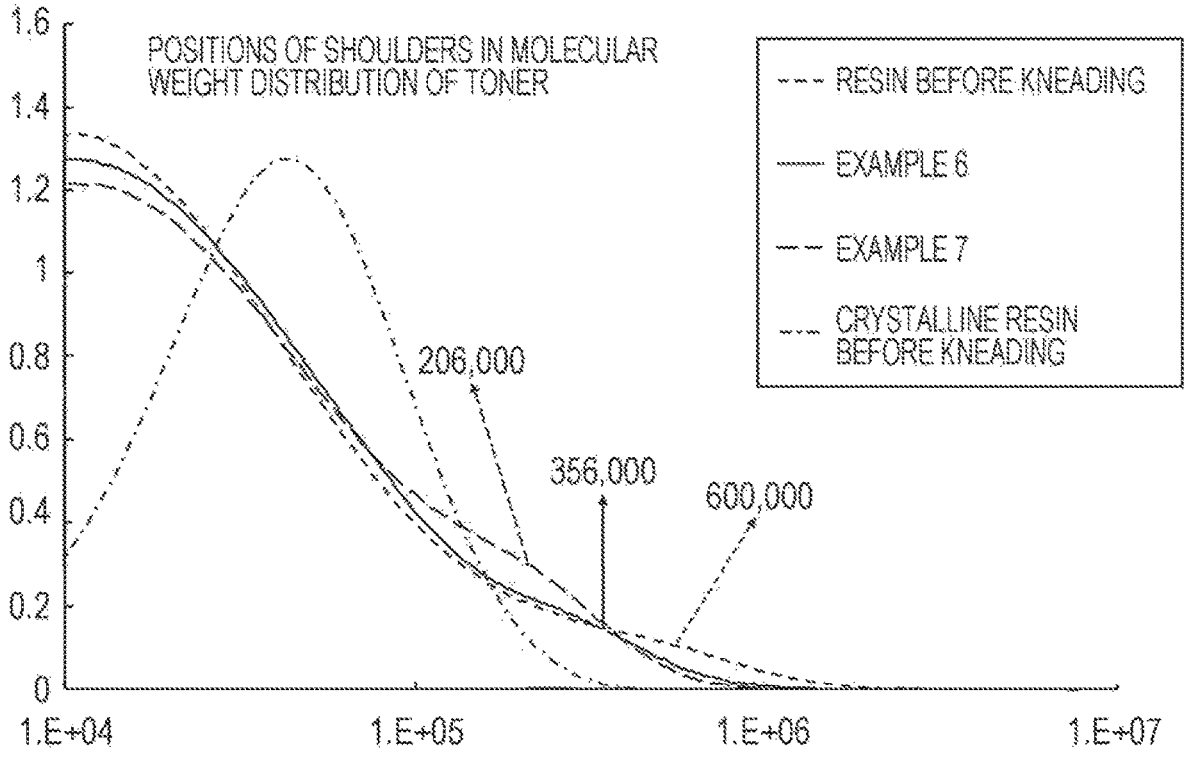
POSITIONS OF SHOULDERS IN MOLECULAR WEIGHT DISTRIBUTION OF TONER
RESIN BEFORE KNEADING
EXAMPLE 6
EXAMPLE 7
CRYSTALLINE RESIN BEFORE KNEADING
206,000
356,000
600,000
1.6
1.4
1.2
1
0.8
0.6
0.4
0.2
0
1.E+04
1.E+05
1.E+06
1.E+07

TONER, TWO-COMPONENT DEVELOPER, AND METHOD FOR PRODUCING TONER

BACKGROUND

1. Field

The present disclosure relates to a toner, a two-component developer containing the toner, and a method for producing the toner and particularly relates to a toner used for electrophotographic image-forming apparatuses, a two-component developer, and a method for producing the toner.

2. Description of the Related Art

To address recent energy saving and the like, there has been a demand on the low-temperature fixing of toner. The low-temperature fixing can be achieved by using a resin with a low melting point, but toner particles fuse each other at high temperature and humidity, which poses a problem in terms of thermal storage stability.

Thus, a crystalline resin has been employed as a resin that does not melt during storage at high temperature and humidity and that melts only when the temperature reaches a relatively low temperature during fixing. The above problem has been addressed because such a crystalline resin has sharp melting properties in which the resin is stable until the temperature reaches a target temperature and the resin quickly melts when the temperature reaches the target temperature.

However, it is difficult to handle such a crystalline resin. In the production of toner, if various materials and the crystalline resin are melt-kneaded and rapidly cooled, the crystallinity changes and a recrystallization process needs to be introduced to recover the original crystallinity. In this recrystallization process, heating needs to be performed for several hours to several days in accordance with the crystallinity, which results in poor productivity in terms of time and cost.

By melt-kneading the crystalline polyester resin and an amorphous linear polyester resin that uses diethylene glycol as an alcohol component, the crystallinity can be maintained without performing the recrystallization process even when rapid cooling is performed after the melt-kneading, and the resulting toner has relatively high storage stability (e.g., refer to Japanese Unexamined Patent Application Publication No. 2017-83525).

SUMMARY

By the above method, a toner whose low-temperature fixability is satisfied can be produced without a recrystallization process that deteriorates the productivity. However, the storage stability of the toner in a severe environment of high temperature and high humidity has been still insufficient and the development memory has been still generated during printing at high temperature and humidity.

The cause of the development memory is believed to be as follows.

1) When the crystalline polyester resin added to achieve low-temperature fixing and low-molecular-weight components (e.g., remaining monomers of resins, unreacted pigments, and pigment dispersants) are compatibilized with each other, the melting point of the crystalline polyester resin decreases.

2) The crystalline polyester resin whose melting point has been decreased at high temperature and humidity is burnt on a magnet roller and deteriorates the flowability of a developer. Consequently, the toner on a sleeve is not completely removed and is left as a history.

3) The previous history (difference in toner density) is slightly left, which generates a development memory on the next image as a difference in developability.

It is desirable to provide a toner that can contribute to low-temperature fixing, has high thermal storage stability, can be efficiently produced without performing recrystallization which deteriorates the productivity, and can provide a printed image without generating a development memory even in a severe environment of high temperature and high humidity, a two-component developer containing the toner, and a method for producing the toner.

According to one aspect of the disclosure, there is provided a toner containing at least a crystalline polyester resin and an amorphous linear polyester resin that uses diethylene glycol as an alcohol component, and a monoester wax and a montan ester wax as release agent components, wherein $6<a<8$ and $14\%<mw/a<30\%$ are satisfied, where a represents parts by weight amount of the crystalline polyester resin added relative to 100 parts by weight of the amorphous linear polyester resin and mw represents parts by weight amount of the montan ester wax added.

According to another aspect of the disclosure, there is provided a two-component developer containing the above toner and a carrier.

According to still another aspect of the disclosure, there is provided a method for producing a toner, the method including mixing raw materials including a pigment master batch under stirring to obtain a mixed product, melt-kneading the mixed product to obtain a melt-kneaded product, cooling and then roughly pulverizing the melt-kneaded product to obtain a roughly pulverized product, finely pulverizing the roughly pulverized product to obtain a finely pulverized product, classifying the finely pulverized product to obtain a toner base particle, and adding an external additive to the toner base particle and performing stirring.

BRIEF DESCRIPTION OF THE DRAWING

The FIGURE schematically illustrates positions of shoulders in the molecular weight distribution of toner.

DESCRIPTION OF THE EMBODIMENTS

Suppression of Development Memory

The use of a montan ester wax containing a metal salt improves the crystallinity because of the nucleation effect of a crystalline polyester resin, which can suppress the development memory. The montan ester wax containing a metal salt also functions as a pigment dispersant, and thus a pigment can be highly dispersed in the toner.

The dispersibilty of a pigment in the toner is dependent on the affinity between the pigment and a resin in the toner. By adding several percent of an additive having an affinity for both the pigment and the resin, the dispersibility of the pigment can be improved.

However, when a crystalline polyester resin is used as in the present disclosure, an excessively high affinity between the crystalline resin and a pigment dispersant causes compatibilization, which also affects the storage stability of a toner containing the pigment dispersant. Furthermore, a crystalline polyester resin whose melting point has been decreased is burnt on a magnet roller and deteriorates the flowability of a developer, which may generate a development memory.

As a comparative example, a carnauba wax contains an ester in an amount of 80% or more. Therefore, a carnauba wax has an affinity for the crystalline polyester resin and has a relatively uniform composition. Thus, the carnauba wax serves as a compatibilizer for the crystalline polyester resin. This generates a development memory in particular at high temperature and humidity.

The montan ester wax containing a metal salt has a more complicated composition than petroleum waxes and synthetic waxes, and mainly contains, for example, a long-chain ester, a free higher fatty acid, and a resin component.

The montan ester wax has an affinity for the crystalline resin because it contains a polar ester like carnauba waxes, but has a complicated (nonuniform) composition, which suppresses the compatibilization of the crystalline resin. Furthermore, the metal salt improves the nucleation effect of the crystalline polyester resin, thereby improving the crystallinity. Thus, it is believed that the montan ester wax contributes to suppressing the development memory.

Hydrocarbon waxes are nonpolar waxes and thus have low compatibility with a principal resin of the present disclosure. Consequently, such a hydrocarbon wax is not sufficiently dispersed in the toner (the dispersion particle size in the toner is large), which facilitates generation of a development memory.

EXAMPLES

Hereafter, one embodiment of the present disclosure will be specifically described based on Examples and Comparative Examples, but the present disclosure is not limited to Examples.

Example 1

Production of Toner

The following toner raw materials were used.

The following materials were used relative to 100 parts by weight of an amorphous polyester resin.

Crystalline polyester resin 7.0 parts by weight

Magenta pigment (Pigment Red 122) 5.0 parts by weight

Charge control agent (manufactured by Japan Carlit Co., Ltd., trade name: LR-147) 1.0 part by weight Wax 1 (monoester:montan ester=70:30) 5.0 parts by weight The above toner raw materials were mixed using a Henschel mixer (manufactured by NIPPON COKE & ENGINEERING CO., LTD., model: FM20C) for five minutes. Then, the resulting mixture was melt-kneaded with a twin-screw extrusion continuous kneader (manufactured by Ikegai Corp., model: PCM-65).

The obtained melt-kneaded product was cooled using a cooling belt, roughly pulverized using a speed mill including a ϕ2 mm screen, finely pulverized using a jet mill (manufactured by Nippon Pneumatic Mfg. Co., Ltd., model: IDS-2), and then classified using an Elbow-Jet classifier (manufactured by Nittetsu Mining Co., Ltd., model: EJ-LABO) to obtain toner base particles having a volume-average particle size of 6.7 μm.

Subsequently, 1.0 part by mass of a first external additive (manufactured by Cabot Corporation, trade name: TG-C190, primary average particle size: 115 nm) and 1.5 parts by mass of a second external additive (manufactured by NIPPON AEROSIL CO., LTD., trade name: R974, primary average particle size: 12 nm) were added as external additives to 100 parts by mass of the obtained toner base particles. The resulting mixture was stirred using a fluidized bed mixer (manufactured by NIPPON COKE & ENGINEERING CO., LTD., Henschel mixer) to produce a toner having a volume-average particle size of 6.7 μm.

Example 2

A toner in Example 2 was produced in the same manner as in Example 1, except that the wax 1 was changed to a wax 2 below.

Wax 2 (monoester:montan ester=60:40) 5.0 parts by weight

Example 3

A toner in Example 3 was produced in the same manner as in Example 1, except that the wax 1 was changed to a wax 3 below.

Wax 3 (monoester:montan ester=80:20) 5.0 parts by weight

Example 4

A toner in Example 4 was produced in the same manner as in Example 3, except that the amount of the crystalline polyester resin added was changed from 7.0 parts by weight to 6.0 parts by weight. The decreased amount of the crystalline polyester resin, 1.0 part by weight, was compensated by increasing the amount of the amorphous polyester resin by 1.0 part by weight.

The toner raw materials in Example 4 are listed below again.

The following materials were used relative to 101 parts by weight of the amorphous polyester resin.

Crystalline polyester resin 6.0 parts by weight

Magenta pigment (Pigment Red 122) 5.0 parts by weight

Charge control agent (manufactured by Japan Carlit Co., Ltd., trade name: LR-147) 1.0 part by weight Wax 2 (monoester:montan ester=80:20) 5.0 parts by weight

Example 5

A toner in Example 5 was produced in the same manner as in Example 2, except that the amount of the crystalline polyester resin added was changed from 7.0 parts by weight to 8.0 parts by weight. The increased amount of the crystalline polyester resin, 1.0 part by weight, was compensated by decreasing the amount of the amorphous polyester resin by 1.0 part by weight.

The toner raw materials in Example 5 are listed below again.

The following materials were used relative to 99 parts by weight of the amorphous polyester resin.

Crystalline polyester resin 8.0 parts by weight

Magenta pigment (Pigment Red 122) 5.0 parts by weight

Charge control agent (manufactured by Japan Carlit Co., Ltd., trade name: LR-147) 1.0 part by weight Wax 2 (monoester:montan ester=60:40) 5.0 parts by weight

Example 6

Production of Pigment Master Batch

The following master batch raw materials were used.

Amorphous polyester resin 110 parts by weight

Magenta pigment (Pigment Red 122) 50 parts by weight

Montan ester wax 15 parts by weight

The above pigment master batch raw materials were mixed using a Henschel mixer (manufactured by NIPPON COKE & ENGINEERING CO., LTD., model: FM20C) for five minutes. The resulting mixture was then melt-kneaded with an open roll continuous kneader (manufactured by NIPPON COKE & ENGINEERING CO., LTD., model: MOS320-1800). The obtained melt-kneaded product was cooled using a cooling belt and then roughly pulverized using a speed mill including a ϕ2 mm screen to obtain a pigment master batch.

Production of Toner

The following toner raw materials were used.

The following materials were used relative to 89 parts by weight of the amorphous polyester resin.

Crystalline polyester resin 7.0 parts by weight

Pigment master batch (above) 17.5 arts by weight

Charge control agent (manufactured by Japan Carlit Co., Ltd., trade name: LR-147) 1.0 part by weight Wax H5 (monoester:montan ester=100:0) 3.5 parts by weight A toner in Example 6 was produced in the same manner as in Example 1 using the above toner raw materials.

Example 7

A toner in Example 7 was produced in the same manner as in Example 6, except that the melt kneader was changed to an open roll continuous kneader (manufactured by NIPPON COKE & ENGINEERING CO., LTD., model: MOS320-1800).

The toner raw materials in Example 7 are listed below again.

The following materials were used relative to 89 parts by weight of the amorphous polyester resin.

Crystalline polyester resin 7.0 parts by weight

Pigment master batch (produced in Example 6) 17.5 parts by weight

Charge control agent (manufactured by Japan Carlit Co., Ltd., trade name: LR-147) 1.0 part by weight Wax H5 (monoester:montan ester=100:0) 3.5 parts by weight Comparative Example 1

A toner in Comparative Example 1 was produced in the same manner as in Example 1, except that the wax 1 was changed to a wax H1 below.

Wax H1 (monoester:montan ester=55:45) 5.0 parts by weight

Comparative Example 2

A toner in Comparative Example 2 was produced in the same manner as in Example 1, except that the wax 1 was changed to a wax H2 below.

Wax H2 (monoester:montan ester=85:15) 5.0 parts by weight

Comparative Example 3

A toner in Comparative Example 3 was produced in the same manner as in Example 5, except that the amount of the crystalline polyester resin added was changed from 8.0 parts by weight to 9.0 parts by weight. The increased amount of the crystalline polyester resin, 1.0 part by weight, was compensated by decreasing the amount of the amorphous polyester resin by 1.0 part by weight.

The toner raw materials in Comparative Example 3 are listed below again.

The following materials were used relative to 98 parts by weight of the amorphous polyester resin.

Crystalline polyester resin 8.0 parts by weight

Magenta pigment (Pigment Red 122) 5.0 parts by weight

Charge control agent (manufactured by Japan Carlit Co., Ltd., trade name: LR-147) 1.0 part by weight Wax 2 (monoester:montan ester=60:40) 5.0 parts by weight.

Comparative Example 4

A toner in Comparative Example 4 was produced in the same manner as in Example 4, except that the amount of the crystalline polyester resin added was changed from 6.0 parts by weight to 5.0 parts by weight. The decreased amount of the crystalline polyester resin, 1.0 part by weight, was compensated by increasing the amount of the amorphous polyester resin by 1.0 part by weight.

The toner raw materials in Comparative Example 4 are listed below again.

The following materials were used relative to 102 parts by weight of the amorphous polyester resin.

Crystalline polyester resin 5.0 parts by weight

Magenta pigment (Pigment Red 122) 5.0 parts by weight

Charge control agent (manufactured by Japan Carlit Co., Ltd., trade name: LR-147) 1.0 part by weight Wax 3 (monoester:montan ester=80:20) 5.0 parts by weight Comparative Example 5

A toner in Comparative Example 5 was produced in the same manner as in Example 1, except that the wax 1 was changed to a wax H5 below.

Wax H5 (monoester:montan ester=100:0) 5.0 parts by weight

Comparative Example 6

A toner in Comparative Example 6 was produced in the same manner as in Example 1, except that the wax 1 was changed to a wax H6 below.

Wax H6 (monoester:montan ester=0:100) 5.0 parts by weight

Comparative Example 7

A toner in Comparative Example 7 was produced in the same manner as in Example 1, except that the wax 1 was changed to a wax H7 below.

Wax H7 (manufactured by NIPPON SEIRO CO., LTD., trade name: FNP-90) 5.0 parts by weight Comparative Example 8

A toner in Comparative Example 8 was produced in the same manner as in Example 1, except that the wax 1 was changed to a wax H8 below.

Wax H8 (manufactured by NIPPON SEIRO CO., LTD., trade name: HNP-10) 5.0 parts by weight Production of Carrier Subsequently, 10 parts by mass of PTFE (manufactured by DAIKIN INDUSTRIES, LTD., trade name: LDE-410) serving as fluorocarbon resin fine particles was added to 100 parts by weight of a silicone resin (manufactured by Shin- Etsu Chemical Co., Ltd., trade name: KR-251) to prepare a resin liquid. A carrier core (manufactured by DOWA IP CREATION Co., Ltd.) was immersed in the resin to produce carriers in Examples 1 to 5 and Comparative Examples 1 to 10.

Production of Two-Component Developer

The toner and carrier produced as described above were mixed with each other at a mass ratio of 8:92 to produce two-component developers in Examples 1 to 5 and Comparative Examples 1 to 8.

Evaluation of Actual Printing Characteristics

For Examples 1 to 7 and Comparative Examples 1 to 8, the development memory, the low-temperature fixability, and the storage stability were evaluated.

Development Memory

In a high-humidity environment (25° C., humidity: 80%), the produced two-component developer was charged into a developing device and a toner cartridge of a multifunction printer (manufactured by Sharp Corporation, model: MX-6150FN), and a document having a printing ratio of 1% was printed on 10000 sheets.

Subsequently, an A3-size chart for confirming development memory was printed. This chart for confirming development memory includes solid circular images at the leading end in a sheet-passing direction, followed by a halftone image. The circular images occupy a region corresponding to one rotation of a developing magnet roller (roller diameter: 18 mm) in a sheet-passing direction. The circular images are eight circular images arranged in a direction perpendicular to the sheet-passing direction. When the chart for confirming development memory is printed, the number of circular images that have been repeatedly printed as ghost images on the halftone image in the sheet-passing direction is checked.

The evaluation criteria are as follows.

A: No repetition

B: Repeated once

C: Repeated twice

D: Repeated three times or more

Low-Temperature Fixability

The produced two-component developer was charged into a developing device and a toner cartridge of the multifunction printer (manufactured by Sharp Corporation, model: MX-6150FN). The temperature of a fixing roller in a fixing device was set to 150° C. ±1° C., and an image sample for measuring fixing strength was prepared at a room temperature of 25° C. and a humidity of 50%.

The image sample for measuring fixing strength was prepared by copying a document including a 3-cm square solid image portion (image density ID=1.5) on recording paper (trade name: PPC paper SF-4AM3, manufactured by Sharp Corporation).

The image sample was folded so that the solid image portion of the image sample faced inward. In the folded state, a 850 g roller was moved back and forth once along a folding line at a particular pressure to prepare a separation sample in which the toner image has been separated at the folded portion.

The separation sample was unfolded and the separated toner was blown away using an air brush. The separation width (the maximum line width of a white background at the folded portion) was measured as an index of fixing strength.

The evaluation criteria of the low-temperature fixability are as follows.

A: Excellent. The separation width is less than 0.2 mm.

B: Good. The separation width is 0.2 mm or more and less than 0.3 mm.

C. Slightly poor. The separation width is 0.3 mm or more and less than 0.5 mm.

D: Poor. The separation width is 0.5 mm or more.

Storage Stability

Into each of three 50 ml plastic vials, 28 to 30 g of the toners in Examples and Comparative Examples were inserted. The plastic vials were placed in a thermo-hygrostat at 50° C. and 10% RH while the caps of the plastic vials were closed. The plastic vials were taken out one by one every 24 hours, and the bulk density of the toners was measured in conformity with JIS K-5101-12-1 using a bulk density measuring instrument (manufactured by TsuTsui Scientific Instruments Co., Ltd.). When the bulk density at the beginning and the bulk density after 72 hours were compared with each other, toners having a smaller variation in bulk density were judged to be better in terms of storage stability. The samples after 24 hours and 48 hours were used to confirm that the bulk density of the toner did not considerably change from the initial bulk density. If the bulk density of the toner considerably changed after 24 hours or 48 hours, this evaluation was stopped at the time.

The retention was calculated from the bulk density of the toner using formula (1) below, and the storage stability was evaluated using the retention.

$$\text{Retention (\%)} = (\text{bulk density after 72 hours}/\text{initial bulk density}) \times 100 \quad (1)$$

The evaluation criteria of the storage stability are as follows.

B: Good. The retention is 80% or more

C: The retention is 70% or more and less than 80%.

D: The retention is less than 70%.

In Example 1, the ratio of the montan ester and the crystalline polyester resin is optimum and the amount of the crystalline polyester resin added relative to the amorphous polyester resin is also well balanced. Therefore, the degree of dispersion of the crystalline polyester resin and the wax in the toner is high and Example 1 is the best in terms of all the development memory, the low-temperature fixability, and the storage stability.

In Example 2, the amount of the montan ester relative to the crystalline polyester resin is relatively large and the crystallinity of the crystalline polyester resin is high. However, the dispersion of the crystalline polyester resin in the amorphous polyester resin slightly deteriorates. Therefore, the development memory and the storage stability in Example 2 are poorer than those in Example 1. No problem is found in terms of low-temperature fixability.

In Example 3, the amount of the montan ester relative to the crystalline polyester resin is relatively small and the crystallinity of the crystalline polyester resin slightly deteriorates. Consequently, the crystalline polyester resin is slightly compatibilized with the amorphous polyester resin. Thus, the development memory and the storage stability in Example 3 are poorer than those in Example 1. No problem is found in terms of low-temperature fixability.

in Example 4, the ratio of the montan ester and the crystalline polyester resin is optimum, but the amount of the crystalline polyester resin added relative to the amorphous polyester resin is relatively small. Therefore, the low-temperature fixability in Example 4 is slightly poorer than that in Example 1. No problem is found in terms of development memory and storage stability.

In Example 5, the ratio of the montan ester and the crystalline polyester resin is optimum, but the amount of the crystalline polyester resin added relative to the amorphous polyester resin is relatively large. Therefore, the development memory and the storage stability in Example 5 are poorer than those in Example 1. However, the low-temperature fixability is better than that in Example 1.

In Example 6, the constituent ratio of materials is the same as that in Example 1, but the montan ester is used as a pigment dispersant for the pigment master batch and thus the degree of dispersion of the montan ester in the toner is higher than that in Example 1. This is believed to increase the crystallinity of the crystalline resin, which further improves the storage stability compared with in Example 1.

In Example 7, it is believed that the polymer chains of resins are further cut by using an open roll continuous kneader capable of applying a higher shear compared with in other Examples and Comparative Examples, which increases the ratio of a resin having a desired molecular weight and thus further improves the fixing strength in the low-temperature fixing test.

The FIGURE schematically illustrates the positions of shoulders in the molecular weight distribution of toner. Herein, the shoulder refers to an inflection point given when the horizontal axis (X axis) shows a molecular weight in a logarithmic scale and the vertical axis (Y axis) shows a molecular weight distribution of the toner in terms of percentage by height. The gradient of a tangent decreases as the molecular weight increases to the inflection point on the horizontal axis. The gradient of the tangent increases as the molecular weight increases from the inflection point.

When kneading is performed with a twin-screw extruder used in Examples other than Example 7, the shoulder shifts to lower molecular weights to a region of 300,000<Mw<500,000 because of the shear during the kneading. In this region, the resin is not excessively hard or excessively brittle and the fixing strength in the low-temperature fixing test is improved.

In Example 7, the shoulder shifts to lower molecular weights to a region of 100,000<Mw<300,000 because of a higher shear applied by using the open roll kneader. This region is an appropriate region in which the resin is not excessively hard or brittle, and thus the fixing strength is further improved.

A toner whose shoulder shifts to lower molecular weights to a region of Mw<100,000 by applying a high shear has not been produced. However, if the polymer chain is excessively cut, the storage stability may deteriorate and the hot offset that occurs at higher temperatures in a fixing region may also readily occur.

When the toner according to an embodiment of the present disclosure that allows low-temperature fixing using a crystalline resin, that does not generate a development memory even under severe conditions of high temperature and high humidity, and that has high thermal storage stability has a shoulder in a region of 100,000<Mw<300,000 of the molecular weight distribution, the low-temperature fixability is further improved. The reason for this is believed to be as follows.

By using a crystalline resin having good sharp melting properties, the fixing temperature can be decreased compared with known toners while high thermal storage stability is achieved at a temperature lower than the fixing temperature. However, the crystalline resin is hard and brittle in a solid state. Therefore, the crystalline resin portion of a toner cooled to room temperature after fixation is believed to have a relatively low folding strength. The above region is believed to be a molecular weight distribution region of an amorphous resin that can reinforce the folding strength, does not impair the low-temperature fixability, can achieve high thermal storage stability, and is compatible with a crystalline resin. The above effect is believed to be large when the ratio of the amorphous resin is high particularly in a high-molecular-weight region in the molecular weight distribution of the crystalline resin (when the amount of a resin having a molecular weight in the region is increased by cutting polymer chains).

In Comparative Example 1, the amount of the montan ester relative to the crystalline polyester resin is excessively large and thus the dispersibility of the crystalline polyester resin in the amorphous polyester resin deteriorates. Therefore, the development memory and the storage stability obviously deteriorate compared with in Example 1.

In Comparative Example 2, the amount of the montan ester relative to the crystalline polyester resin is insufficient and thus the crystalline polyester resin is compatibilized with the amorphous polyester resin. Therefore, the development memory and the storage stability obviously deteriorate compared with in Example 1.

In Comparative Example 3, the ratio of the montan ester and the crystalline polyester resin is optimum, but the amount of the crystalline polyester resin added relative to the amorphous polyester resin is excessively large. Therefore, the low-temperature fixability is equal to that in Example 1, but the development memory and the storage stability obviously deteriorate.

In Comparative Example 4, the ratio of the montan ester and the crystalline polyester resin is optimum, but the amount of the crystalline polyester resin added relative to the amorphous polyester resin is insufficient. Therefore, the development memory and the storage stability are equal to those in Example 1, but the low-temperature fixability obviously deteriorates.

In Comparative Example 5, the montan ester is not contained in a wax component at all and only the monoester is contained. Consequently, the crystalline polyester resin is compatibilized with the amorphous polyester resin. Therefore, all the development memory, the low-temperature fixability, and the storage stability obviously deteriorate compared with in Example 1.

In Comparative Example 6, the monoester is not contained in a wax component at all and only the montan ester is contained and thus the wax is not sufficiently dispersed in the toner. Therefore, all the development memory, the low-temperature fixability, and the storage stability obviously deteriorate compared with in Example 1.

In Comparative Example 7, the whole wax is replaced with a Fischer-Tropsch wax. Consequently, the wax is not sufficiently dispersed in the toner and low-molecular-weight components other than the principal component are contained. This adversely affects the development memory and the storage stability, and thus all the development memory, the low-temperature fixability, and the storage stability deteriorate compared with in Example 1.

In Comparative Example 8, the whole wax is replaced with a paraffin wax. Consequently, the wax is not sufficiently dispersed in the toner and thus all the development memory, the low-temperature fixability, and the storage stability obviously deteriorate compared with in Example 1.

TABLE 1

| | Type of wax | | | | Addition amount relative to 100 parts by weight of α-PES | | | |
|---|---|---|---|---|---|---|---|---|
| | First type | | Second type | | Total amount | | | |
| Example | Type | Wax fraction | Type | Wax fraction | of wax | Montan | C-PES | Montan/C-PES |
| Example 1 | WEP-3 | 70% | Montan | 30% | 5% | 1.50% | 7% | 21.43% |
| Example 2 | WEP-3 | 60% | Montan | 40% | 5% | 2.00% | 7% | 28.57% |
| Example 3 | WEP-3 | 80% | Montan | 20% | 5% | 1.00% | 7% | 14.29% |
| Example 4 | WEP-3 | 80% | Montan | 20% | 5% | 1.00% | 6% | 16.67% |
| Example 5 | WEP-3 | 60% | Montan | 40% | 5% | 2.00% | 8% | 25.00% |
| Example 6 | WEP-3 | 70% | Montan | 30% | 5% | 1.50% | 7% | 21.43% |
| Example 7 | WEP-3 | 70% | Montan | 30% | 5% | 1.50% | 7% | 21.43% |
| Comparative Example 1 | WEP-3 | 55% | Montan | 45% | 5% | 2.25% | 7% | 32.14% |
| Comparative Example 2 | WEP-3 | 85% | Montan | 15% | 5% | 0.75% | 7% | 10.71% |
| Comparative Example 3 | WEP-3 | 60% | Montan | 40% | 5% | 2.00% | 9% | 22.22% |
| Comparative Example 4 | WEP-3 | 80% | Montan | 20% | 5% | 1.00% | 5% | 20.00% |
| Comparative Example 5 | WEP-3 | 100% | Montan | 0% | 5% | 0.00% | 7% | 0.00% |
| Comparative Example 6 | WEP-3 | 0% | Montan | 100% | 5% | 5.00% | 7% | 71.43% |
| Comparative Example 7 | FNP-90 | 100% | Montan | 0% | 5% | 0.00% | 7% | 0.00% |
| Comparative Example 8 | HNP-10 | 100% | Montan | 0% | 5% | 0.00% | 7% | 0.00% |
| Production Example | WEP-3 | 70% | Montan | 30% | 5.28% | 1.58% | 7.19% | 22.03% |

| | | Evaluation result | | |
|---|---|---|---|---|
| Example | Remarks | Development memory | Low-temperature fixing | Storage stability |
| Example 1 | Suitable conditions (30% in wax) | A | B | B |
| Example 2 | Upper limit of amount of montan (40% in wax) | C | B | C |
| Example 3 | Lower limit of amount of montan (20% in wax) | C | B | C |
| Example 4 | Medium amount of montan (40% in wax), small amount of C-PES | B | C | B |
| Example 5 | Medium amount of montan (40% in wax), large amount of C-PES | C | A | C |
| Example 6 | Montan in claim 1 was used as dispersant | A | B | A |
| Example 7 | Kneading in Example 6 was performed with open roll kneader | A | A | A |
| Comparative Example 1 | Excessive amount of montan | D | C | D |
| Comparative Example 2 | Insufficient amount of montan | D | C | D |
| Comparative Example 3 | Medium amount of montan, excessive amount of C-PES | D | B | D |
| Comparative Example 4 | Medium amount of montan, insufficient amount of C-PES | B | D | B |
| Comparative Example 5 | Only monoester wax | D | D | D |
| Comparative Example 6 | Only montan ester wax | D | D | D |
| Comparative Example 7 | Only Fischer-Tropsch wax | D | D | D |
| Comparative Example 8 | Only paraffin wax | D | D | D |
| Production Example | | | | |

α-PES: amorphous polyester resin

C-PES: crystalline polyester resin

WEP-3: monoester wax manufactured by NOF CORPORATION

Montan: montan ester wax (derived from mineral oil, constituted by a plurality of compounds, containing a metal salt)

FNP-90: Fischer-Tropsch wax (synthetic hydrocarbon wax, the molecular weight distribution is slightly broad and similar to that of montan ester waxes, but has a small peak in a low-molecular-weight range)

HNP-10: linear paraffin wax (not easily dispersed because of low affinity for amorphous linear polyester resins)

WE-12: mixed wax of WEP-3/montan ester wax = 7/3 (suitable for dispersion in the principal resin of the present disclosure)

The affinity for the principal resin (amorphous linear polyester resin) of the present disclosure (High) WEP8, carnauba > WEP3 > WE12 > montan > hydrocarbon wax (Low)

The present disclosure contains subject matter related to that disclosed in Japanese Priority Patent Application JP 2018-076583 filed in the Japan Patent Office on Apr. 12, 2018, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A toner comprising:

at least a crystalline polyester resin and an amorphous linear polyester resin that diethylene glycol as an alcohol component that is a reacted part of the amorphous linear polyester resin; and a monoester wax and a montan ester wax as release agent components, wherein $6<a<8$ and $14\%<mw/a<30\%$ are satisfied, where a represents parts by weight amount of the crystalline polyester resin added relative to 100 parts by weight of the amorphous linear polyester resin and mw represents parts by weight amount of the montan ester wax added, wherein when an inflection point given when a horizontal axis shows a molecular weight in a logarithmic scale and a vertical axis shows a molecular weight distribution of the toner in terms of percentage by height is referred to as a shoulder, the shoulder is present in a region of $100{,}000<Mw<300{,}000$, where Mw represents a weight-average molecular weight of the molecular weight distribution.

2. A two-component developer comprising:

the toner according to claim 1; and a carrier.

* * * * *